US005725413A

United States Patent [19]

Malshe et al.

[11] Patent Number: 5,725,413

[45] Date of Patent: *Mar. 10, 1998

[54] APPARATUS FOR AND METHOD OF POLISHING AND PLANARIZING POLYCRYSTALLINE DIAMONDS, AND POLISHED AND PLANARIZED POLYCRYSTALLINE DIAMONDS AND PRODUCTS MADE THEREFROM

[75] Inventors: Ajay P. Malshe; Hameed A. Naseem; William D. Brown, all of Fayetteville, Ark.

[73] Assignee: Board of Trustees of the University of Arkansas, Little Rock, Ark.

[ * ] Notice: The term of this patent shall not extend beyond the expiration date of Pat. No. 5,472,370.

[21] Appl. No.: 239,362

[22] Filed: May 6, 1994

[51] Int. Cl.[6] ..... B24B 1/00; B24B 7/19; B24B 7/30

[52] U.S. Cl. ..... 451/41; 451/289; 451/7

[58] Field of Search ..... 451/7, 41, 53, 451/54, 259, 283, 287, 288, 289, 312, 319, 324, 325; 51/295, 307; 125/30.01

[56] References Cited

U.S. PATENT DOCUMENTS

| | | | |
|---|---|---|---|
| 1,933,373 | 10/1933 | Fraser | 51/131 |
| 3,421,956 | 1/1969 | Ebert et al. | 156/17 |
| 3,720,689 | 3/1973 | Pohl et al. | 260/343 |
| 4,519,168 | 5/1985 | Cesna | 51/216 LP |
| 4,601,755 | 7/1986 | Melard et al. | 106/3 |
| 4,662,348 | 5/1987 | Hall et al. | 125/30 |
| 4,925,701 | 5/1990 | Jansen et al. | 427/38 |
| 5,006,203 | 4/1991 | Purdes | 156/646 |
| 5,017,403 | 5/1991 | Pang et al. | 427/39 |
| 5,104,828 | 4/1992 | Morimoto et al. | 437/225 |
| 5,133,792 | 7/1992 | Purohit et al. | 134/26 |
| 5,225,275 | 7/1993 | Aida | 428/334 |
| 5,244,712 | 9/1993 | Eden | 428/142 |
| 5,246,884 | 9/1993 | Jaso et al. | 437/225 |
| 5,248,079 | 9/1993 | Li | 228/121 |
| 5,297,365 | 3/1994 | Nishioka et al. | 51/283 R |
| 5,300,188 | 4/1994 | Tessmer et al. | 156/636 |
| 5,392,982 | 2/1995 | Li | 228/124.5 |
| 5,472,370 | 12/1995 | Malshe et al. | 451/41 |

OTHER PUBLICATIONS

"Searching for perfect planarity", Semiconductor International, Mar. 1992.

"Chemical vapor deposition of diamond for electric packaging applications", David J. Pickrell and David S. Hoover, Inside ISHM Jul. Aug. 1991, at 11–15.

"Diffusion–controlled subcritical crack growth in the presence of a dilute gas environment", B. R. Lawn, Materials Science and Engineering, 13 (1974) 277–283.

"Tewksbury Lecture: control and application of environment–sensitive fracture processes", A.R.C. Westwood, Journal of Materials Science 9 (1974) 1871–1895.

"The polishing of diamonds in the presence of oxidising agents", A.G. Thornton and J. Wilks, Diamond Research 1974, Supplement to Industrial Review, pp. 39–42 (1974).

"Micro–deformation of crystals subjected to point loading", C.A. Brookes et al, Diamond Research, 1974 Supplement to Industrial Diamond Review, pp. 11–15.

(List continued on next page.)

*Primary Examiner*—James G. Smith
*Assistant Examiner*—Derris H. Banks
*Attorney, Agent, or Firm*—Gilbreth & Strozier, P.C.; J.M. (Mark) Gilbreth; Robert W. Strozier

[57] ABSTRACT

Disclosed are polished and planarized diamond films and a method and apparatus for polishing and planarizing diamond films. The method generally includes mechanical polishing of the diamond film against a ceramic surface in the presence of a treating agent of potassium nitrate and a polishing agent of potassium hydroxide. The produced films have an average surface roughness on the order of 0.05 microns, a planarization uniformity within eight percent, and are relatively free of process-induced contaminants.

29 Claims, 5 Drawing Sheets

OTHER PUBLICATIONS

Chemical Abstracts, Jun. 3, 1991, vol. 114, No. 22, 114:215800q "Mechanism of the catalytic activiy of potassium hydroxide for oxidation of diamond and graphite by molecular oxygen".

"Diamond Thin Film: Applications in Electronics Packaging", David S. Hoover et al, Feb. 1991, Solid State Technology at 89–92.

"Will diamond shine for ICs?", Semiconductor International Dec. 1993 at 48–52.

"Planarizing Interlevel Dielectrics by Chemical–Mechanical Polishing", Srinivasan Siraram et al., Solid State Technology, May 1992, at 87–91.

"Diamond Depositions — science & technology" Superconductivity Publications, Inc. 1992, vol. 3, No. 1, at 1, 5 and 6.

"Tribological properties of polished diamond films", Bharat Bhushan et al, J. Appl. Phys. 74(6), 15 Sep. 1993 at 4174–4180.

"Friction and Wear Properties of Chemomechanically Polished Diamond Films", B.K. Gupta, The American Society of Mechanical Engineers STLE/ASME Tribology Conference, New Orleans, La, Oct. 24–27, 1993, 3–Trib–20.

"Smoothing of chemically vapour deposited diamonds films by ion beam irradiation", Atsushi Hirata et al., Thin Solid Films, 212 (1929) 43–48.

"Thermal conductivity in molten–metal–etched diamond films", S. Jin et al., Appl. Phys. Lett. 63 (5), 2 Aug. 1993, at 622–624.

"Growth, polishing, and optical scatter of diamond thin films", T. P. Thorp et al, SPIE vol. 1325 Diamond Optics III (1990) at 230–237.

Gemstones For Everyman, B.W. Anderson, 8th revised edition, 1971 at 62 and FIGS. 6a and 6b.

"Etching of HFCVD Diamond Films in Air, Nitrous Oxide and Argon", K Tankala et al., New Diamond Science and Technology, 1991, at 827–831.

"Thermogravimetric analysis of the oxidation of CVD diamond films", Curtis E. Johnson et al., m J. Mater. Res., vol. 5, No. 11, Nov. 1990, at 2320–2325.

"Smoothening of diamond films with an ArF Laser" Bogli et al., Diamond and Related Materials, 1 (1992) 782–788.

"Laser Polishing of Diamond", Ravi et al., Proceedings fo the Third International Symposium on Diamond Materials.

"Planarizing technique for ion–beam polishing of diamond films", Grogen et al., Applied Optics, vol. 31, No. 10, Apr. 1, 1992, at 1483–1487.

"Development and Performance of a Diamond Film Polishing Apparatus with Hot Metals", Masanori Yoshikawa, SPIE vol. 1325 Diamond Optics III (1990).

Aug. 1995 PCT International Search Report.

α — Roughness

β — Waviness

CVD-diamond film, #TA 1163, before polishing.

APPARATUS FOR AND METHOD OF POLISHING AND PLANARIZING POLYCRYSTALLINE DIAMONDS, AND POLISHED AND PLANARIZED POLYCRYSTALLINE DIAMONDS AND PRODUCTS MADE THEREFROM

BACKGROUND OF THE INVENTION

1. Field of the invention

The present invention relates to diamonds and diamond-like materials, products made thereof, and to an apparatus for and method of processing diamonds and diamond-like materials. In another aspect, the present invention relates to polished diamonds and diamond-like materials, to products made thereof, and to an apparatus for and method of polishing diamonds and diamond-like materials. In still another aspect, the present invention relates to polished and planarized diamonds and diamond-like materials, to products made thereof, and to an apparatus for and a method of polishing and planarizing diamonds and diamond-like materials. In even another aspect, the present invention relates to polished and planarized polycrystalline diamonds, to products made thereof, and to a chemomechanical apparatus for and method of polishing and planarizing polycrystalline diamonds.

2. Description of the Related Art

The physical and chemical properties of natural diamonds render them suitable for use in a wide range of applications. For example, natural diamonds are the hardest substance known and exhibit low friction and wear properties. Specifically, a natural diamond's thermal conductivity, thermal diffusivity properties, electrical resistivity and microhardness invite its substitution in various applications.

Likewise, it is believed that diamond films would find utility in a broad range of uses.

Unfortunately, diamond films are not naturally occurring, but rather must be manufactured using any of a host of techniques, such as, chemical vapor deposition, physical vapor deposition, plasma spray or cathode sputtering.

Fortunately, however, the physical and chemical properties of synthetic diamond films have been found to be comparable to those of bulk diamond.

For example, it has been reported that electron assisted chemical vapor deposition films have electrical resistivities greater than $10^{13}$ Ω-cm, microhardness of about 10,000 HV, thermal conductivity of about 1100 W $m^{-1}$ $K^{-1}$, and thermal diffusivity of 200 to 300 $mm^2$/s. These compare favorably to those properties of natural diamond, i.e., resistivities in the range of $10^7$ to $10^{20}$ Ω-cm, microhardness in the range of 8,000 to 10,400 HV, thermal conductivity in the range of 900 to 2100 W $m^{-1}$ $K^{-1}$, and thermal diffusivity of 490 to 1150 $mm^2$/s. Thermal gravimetric analysis demonstrates the oxidation rates of diamond films in the range of 500° to 750° C. have been found to be lower than that of natural diamond. Additionally, it is reported that the starting temperature of oxidation for microwave-assisted chemical vapor deposition diamond film is about 800° C., as evidenced by weight loss, while the morphology shows visible oxidation etching pits at temperatures as low as 600° C.

Surface roughness and waviness are two properties of importance in determining the suitability of a diamond film in a given application. Proper surface roughness is perhaps the major constraint for the widespread use of diamond films in thermal management, electrical, optical and tribological applications.

The growth of diamond film on a nondiamond substrate is initiated by nucleation either at randomly seeded sites or at thermally favored sites due to statistical thermal fluctuation at the substrate surface. Based on growth temperature and pressure conditions, favored crystal orientations dominate the competitive growth process. As a result, the grown films are polycrystalline in nature with relatively large grain size, generally greater than one micron, and terminating in rough surfaces with roughness ranging from about a few tenths of a micron to tens of microns. Such films will offer insufficient planar areas, and will likely not be suitable for most of the applications, in particular for thermal management applications.

Another common characteristic of polished diamond surfaces is waviness, the periodic or aperiodic wave-like variation from a perfectly planar surface, which is generally much larger and wider than the roughness. Depending upon the application of the product, waviness may be undesirable while minute scratches can be tolerated. For example, in gauge blocks, the polished steel surface has little waviness but on a microscopic scale is scratched.

As is well known, diamond is the hardest substance known and is therefore difficult to polish. In general, abrasive polishing techniques require the use of a mating/polishing grit material of equal or greater hardness than the material to be polished. While other materials may be polished utilizing harder substances, diamonds are generally polished only with diamonds.

Various prior art methods have been suggested to improve upon the abrasive polishing of diamonds. For example, in "Polishing diamonds in the presence of oxidizing agents", Thornton et al., Diamond Research 1974, Supplement to Industrial Review, pp. 39 (1974), disclose that the polishing of a natural diamond stone with diamond powder and an iron scaife may be enhanced by first applying a concentrated aqueous solution of potassium nitrate on the iron scaife.

Typically, polishing with diamond powder commences with relatively coarse hard powder which continuously scratches the surface of the material being polished until all of the scratches remaining on the surface are as small as can be made with that size powder. The next step is to polish with a smaller size powder until all of the larger scratches are removed and the only remaining scratches are the smallest that can be produced with this second size powder. This continues with successively smaller powder sizes until the desired degree of polishing is obtained. Obviously, the polish finish will always depend upon the size of powder utilized.

U.S. Pat. No. 4,662,348, issued May 5, 1987 to Hall et al. discloses a method of burnishing a diamond which eliminates the necessity of diamond powder. As disclosed, a polished diamond surface is obtained by rubbing a surface of the diamond to be polished against a smooth complementary diamond surface with sufficient pressure and velocity to heat the surface being polished above the spontaneous thermal degradation temperature of the diamond.

Unfortunately, traditional abrasive polishing methods utilizing diamond powder or complementary surfaces are unsuitable for the diamond films because of extremely low polishing rates and preferential polishing along specific crystal directions leaving grooves on the surface.

As alternatives to the traditional abrasive polishing methods, various physical and chemical means have been explored to etch or polish diamond films. These alternative methods can be generally classified as thermochemical polishing, plasma/ion beam/laser polishing and chemomechanical polishing.

Thermochemical techniques generally involve the mechanical contact of the diamond film to certain metals at elevated temperatures. Here, the diamond surface is put in not only mechanical but also thermal contact, typically with a spinning hot plate. Commonly iron is the preferred plate material as above 723° C. the solubility of carbon in an iron matrix increases and thus unwanted diamond asperities can be dissolved in the iron matrix. However, the technique offers polished films with non-diamond surface and intergrain contaminations.

Plasma, ion beam and laser polishing are non-contact polishing techniques, generally do not require bulk sample heating and can be used on nonplanar surfaces. To date, the material removal rates of these techniques have been small. Additionally, these techniques require a controlled environment, generally a vacuum, and require expensive equipment.

It is well known that a diamond can be etched by exposure to an etching agent such as potassium nitrate or potassium chlorate at elevated temperatures, generally above 600° C. However, etching generally results in a deeply pitted diamond surface with the etching preferentially occurring at dislocations and other defects.

For example, U.S. Pat. No. 5,133,792, issued Jul. 28, 1992 to Purohit et al., discloses a method of cleaning and refining by soaking diamonds in caustic or acidic solutions for durations of possibly more than a day at temperatures in the range about 200° C. to about 500° C.

This caustic refining treatment breaks down and dissolves complex oxides, other glassy structures, and metallic impurities in the diamonds. The caustic treatment is disclosed as comprising either potassium hydroxide or sodium hydroxide, at an aqueous concentration of 40 to 100%, and potassium nitrate which may be added to aqueous solution at 1 gram for every 5 to 30 milliliters of solution.

The acid refining treatment removes remaining metallic impurities by forming water soluble chlorides, nitrates, fluorides or other compounds.

Between acidic and caustic treatments, the diamonds are sequentially rinsed with water, acetone and alcohol, possibly at boiling temperatures, to remove all traces of the solvents used in the previous process step and avoid reaction with or contamination of the solvents to be used in the next treatment.

Chemical mechanical methods generally include a first polishing step in which the diamond film is coarsely polished by lapping against a polycrystalline alumina plate in the presence of fused potassium nitrate. Next, the diamond film is finely polished by lapping against a rough film in the presence of fused potassium nitrate. However, the resultant diamond film has amorphous non-diamond contaminations on the surface, probably from the mating diamond film surface or as a result of extreme interfacial frictional heating.

While various prior art methods and apparatus for polishing diamond films and products from diamond films exist, they each suffer from one or more disadvantages. The ideal processing method would both polish and planarize, as well as be non-contaminating to the diamond surface.

For example, thermochemical, ion beam, and mechanical lapping methods all achieve reasonable levels of polishing but fail to planarize the diamond film. Additionally, while laser methods produce polishing on the order of 0.05 microns, contamination by the formation of graphitic or diamond-like carbon layers occurs. While ion beam methods produce polishing on the order of 0.005 microns, the surface roughness is non-uniform due to ion-beam non-uniformity. Plasma methods achieve highly non-uniform polishing and contamination in the form of residue formation on the surface between grain boundaries. Mechanical lapping methods produce polishing on the order of 0.02 microns, but cause surface structural deformations, another kind of contamination, on the micro-scale.

Also, although the thermochemical technique offers a fine surface finish, surface non-uniformities are introduced partially from the mating metal surface, and partially from excessive interfacial frictional heating, and contamination occurs with the formation of a diamond-like carbon layer and metal residues in the grain boundaries.

Therefore, there is a need in the art for an improved method of processing diamonds and diamond-like materials.

There is another need in the art for an improved apparatus for processing diamonds and diamond-like materials.

There is still another need in the art for improved products made from diamonds and diamond-like materials.

There is yet another need in the art for improved planarized diamond and diamond-like materials, improved products made thereof, and for an improved apparatus and for an improved method of planarizing diamonds and diamond-like products.

There is even another need in the art for improved polished diamond and diamond-like materials, improved products made thereof, and for an improved apparatus and for an improved method of polishing diamonds and diamond-like products.

There is still yet another need in the art for an improved method of and apparatus for polishing diamonds and diamond-like materials to obtain a highly polished surface, which method and apparatus eliminates the need to utilize diamond as the abrasive polishing material.

There is still even another need in the art for an improved chemical-assisted mechanical diamond polishing method and apparatus that yield improved polishing results as compared to the prior art chemomechanical polishing methods and apparatus.

There is even yet another need in the art for an improved chemical-assisted mechanical diamond polishing method and apparatus having improved polishing rates as compared to the prior art chemomechanical polishing methods and apparatus.

There is still even yet another need in the art for an improved chemical-assisted diamond polishing method and apparatus that will both polish and planarize a diamond and diamond-like materials and provide a resulting product having a diamond or diamond-like surface, essentially free of the polishing-induced contaminants.

These and other needs in the art will become readily apparent to one of skill in the art of this invention upon reading this specification.

SUMMARY OF THE INVENTION

It is one object of the present invention to provide a method of processing diamonds and diamond-like materials.

It is another object of the present invention to provide an apparatus for processing diamonds and diamond-like materials.

It is still another object of the present invention to provide for products made from diamonds and diamond-like materials.

It is yet another method of the present invention to provide planarized diamond and diamond-like materials, products made thereof, and an apparatus for and method of planarizing diamonds and diamond-like products.

It is even another object of the present invention to provide polished diamond and diamond-like materials, products made thereof, and an apparatus for and method of polishing diamonds and diamond-like products.

It is still yet another object of the present invention to provide a method of and apparatus for polishing diamonds and diamond-like materials to obtain a highly polished surface, which method and apparatus eliminates the need to utilize diamond as the abrasive polishing material.

It is still even another object of the present invention to provide a chemical-assisted mechanical diamond polishing method and apparatus that yield improved polishing results as compared to the prior art chemomechanical polishing methods and apparatus.

It is even yet another object of the present invention to provide a chemical-assisted mechanical diamond polishing method and apparatus having improved polishing rates as compared to the prior art chemomechanical polishing methods and apparatus.

It is still even yet another object of the present invention to provide for an improved chemical-assisted mechanical diamond polishing method and apparatus that will both planarize and polish a diamond and diamond-like materials and provide a resulting product having a diamond or diamond-like surface, essentially free of surface structural deformations.

These and other objects of the present invention will become readily apparent to one of skill in the art of this invention upon reading this specification.

According to one embodiment of the present invention there is provided a process for treating a superhard surface. The treatment will generally result in polishing and planarizing of the superhard surface. The treating method of this embodiment generally includes abrasive contacting of a first superhard surface with a second superhard surface at sufficient pressure and velocity to polish the first superhard surface. The abrasive contacting occurs in the presence of a liquid treating agent and a polishing agent. Most preferred liquid treating agents and polishing agents are potassium nitrate and potassium hydroxide, respectively. Preferably, the liquid treating agent and the polishing agent are mixed together.

According to a more specific embodiment of the present invention there is provided a process for treating a diamond surface. The treatment will generally result in the polishing and planarizing of the diamond. The method of this embodiment generally comprises abrasive contacting the diamond surface with a superhard surface at sufficient pressure and velocity to polish the diamond surface. In this method, the superhard surface has a Mohs hardness of at least 5, and the abrasive contacting occurs in the presence of a liquid treating agent and a polishing agent. Again, most preferred liquid treating agents and polishing agents are potassium nitrate and potassium hydroxide, respectively, which are generally contacted together.

According to another embodiment of the present invention there is provided a planarized polished diamond product. The planarized polished diamond product of this invention comprises a polished surface having an average surface roughness of less than about 0.05 microns, less than 8 percent variation in planarization, and essentially free of process contamination.

According to yet another embodiment of the present invention there is provided an apparatus for treating a superhard surface. The treating will generally result in polishing and planarizing of the superhard surface. The treating apparatus of this embodiment generally includes a frame to which is mounted a motor assembly. The apparatus also includes a mounting surface upon which the superhard surface is mounted. The apparatus also includes a mating surface with which the superhard surface to be polished is contacted. The mating surface is held in a fixed position on a heater supported by the frame. The apparatus also includes a shaft assembly connecting the motor assembly to the mounting surface to contact the superhard surface to be polished against the mating surface at sufficient pressure and velocity to polish the first superhard surface. The apparatus further includes a treating agent and a polishing medium at the interface of the superhard surface and the mating surface. Most preferred treating agents and polishing agents are potassium nitrate and potassium hydroxide, respectively.

DETAILED DESCRIPTION OF THE INVENTION

Figure 1:
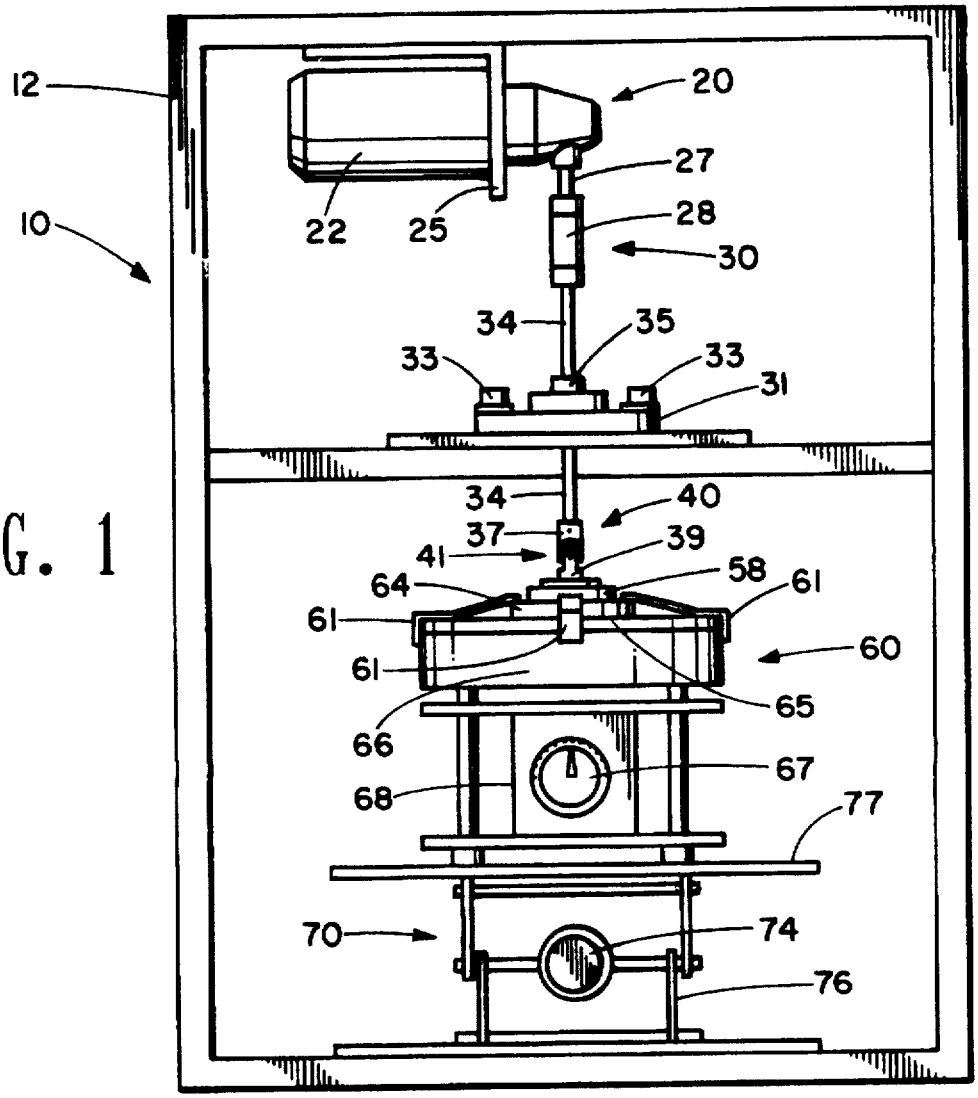
FIG. 1 is a schematic representation of polishing apparatus 10 of the present invention showing motor assembly 20, shaft assembly 30, polishing assembly 40, heating assembly 60, and jack assembly 70.

One embodiment of the method of the present invention generally includes abrasive contacting of the diamond or diamond-like material to be processed with a polishing surface, in the presence of a treating agent and a polishing agent. It is to be understood that the present invention can be used to polish and/or planarize diamonds or diamond-like materials.

Another embodiment of the method of the present invention generally includes abrasive contacting of the diamond or diamond-like material to be processed with a polishing surface, wherein the abrasive contacting occurs in the presence of a polishing agent, and wherein the material is affixed to a support substrate utilizing a suitable adhesive.

The diamond films or substrates utilized in the present invention may be produced using any suitable method and means. Common methods of producing diamond and diamond-like films include ion beam deposition, chemical vapor deposition, plasma enhanced chemical vapor deposition and sputter deposition.

Briefly, ion beam deposition typically involves producing carbon ions to selected energies for deposit on a substrate. Chemical vapor deposition and plasma enhanced vapor deposition methods are similar in operation. Both methods use the dissociation of organic vapors to produce both carbon ions and neutral atoms of carbon for deposit on a substrate. Finally, sputtering deposition usually includes two ion sources, one for sputtering carbon from a graphite source onto a substrate, and another ion source to breaking the unwanted graphite bonds in the growing film.

The polishing surface utilized in the present invention may be any suitable surface that will impart the desired polished finish upon the diamond, and that will also withstand exposure to the treating agent and the polishing agent. Generally, the polishing surface of the present invention may comprise metal carbides, metal oxides, metal nitrides, and ceramics. Preferably, the polishing surface utilized in the present invention will comprise a metal oxide ceramic, most preferably an alumina ceramic.

Generally, the polishing surface will have a Mohs hardness of about 5 or more. Preferably, the polishing surface utilized in the present invention will have a Mohs hardness of about 7 or more, and most preferably of about 9 or more.

A series of polishing surfaces may be utilized having increasing degrees of smoothness. Generally, a rougher surface is first utilized, followed by smoother and smoother surfaces, until the desired surface finish is achieved.

The polishing surfaces utilized will have surface roughnesses in the range of about 10 μm to about 1 nm.

The treating agent utilized may be any suitable agent that when utilized in the method of the present invention will facilitate the desired polishing of the diamond. Generally, the treating agent will generate at least one radical selected from the group of radicals consisting of O, Cl, S, Fl, SO, $SO_2$, OH, NO, or $NO_2$ to facilitate the desired polishing of the diamond or diamond-like material. Suitable agents generally reactive agents such as chlorides, nitrates, hydroxides, nitrites, fluorides, sulfides and metals thereof.

Non-limiting examples of such suitable treating agents include potassium chloride, potassium nitrite, potassium hydroxide, sodium hydroxide, sodium nitrate, sodium nitrite, chromium trioxide, potassium-dichromate, manganese oxide, potassium chromate and mixtures thereof. Preferably, the treating agent comprises a metal nitrate. Most preferably, the treating agent comprises potassium nitrate.

The polishing agent utilized may be any suitable polishing agent that when utilized in the method of the present invention will enhance polishing of the diamond. Suitable polishing agents generally include diamond oxidation rate enhancers, such as chlorides, nitrates, hydroxides, nitrites, fluorides, sulfides and metals thereof.

Non-limiting examples of such suitable polishing agents include potassium chloride, potassium nitrite, potassium hydroxide, sodium hydroxide, sodium nitrate, sodium nitrite, chromium trioxide, potassium-dichromate, manganese oxide, potassium chromate and mixtures thereof. Preferably, the polishing agent comprises a metal hydroxide. Most preferably, the polishing agent comprises potassium hydroxide.

In the practice of the present invention, the abrasive polishing will occur in the presence of the polishing agent and/or the treating agent. While the abrasive polishing may occur in the presence of either the polishing or treating agent, it is preferred that the abrasive contacting occur in the presence of both the polishing and treating agent. The polishing agent and the treating agent are generally selected to be compatible with any solvent utilized in the invention.

In the practice of the present invention, the treating agent is generally present in an amount suitable to facilitate the desired polishing of the diamond film. The polishing agent is generally present in an amount suitable to enhance the polishing of the diamond film.

The relative amounts of treating agent and polishing agent will generally depend upon the purity of the diamond or diamond-like material being polished. For example, less potassium hydroxide polishing agent is utilized where graphite inclusions in the diamond film are high. The treating agent is generally present in the range of about 0.1 to about 99.9 weight percent, and the polishing agent is generally present in the range of about 99.1 to about 0.1 weight percent, based on the total weight of treating agent and polishing agent. Preferably, the treating agent is present in the range of about 90 to about 99 weight percent, and the polishing agent is generally present in the range of about 10 to about 1 weight percent, based on the total weight of treating agent and polishing agent. Most preferably, the treating agent is present in the range of about 95 to about 99 weight percent, and the polishing agent is generally present in the range of about 5 to about 1 weight percent, based on the total weight of treating agent and polishing agent.

The treating agent and the polishing agent may be utilized in undiluted liquid form or may be dissolved in a solvent. When utilized in a solvent, the treating agent and the polishing agent will generally comprise in the range of about 1 to about 99 weight percent of the solution.

The polishing method of the present invention is generally carried out at conditions that are suitable to maintain the treating agent and the polishing agent in the liquid state and produce the desired polished product.

Thus, in the practice of the present invention, the polishing temperature is maintained between the melting point and the boiling point of the treating agent and/or the polishing agent at the particular operating pressure. Other limitations on the temperature generally include operating below the degradation temperature of the diamond or diamond-like material. For diamonds, the onset of degradation generally occurs at about 900K. in an oxygen ambient and at about 1800K. in an inert environment.

The operating pressure of the present invention is generally suitable to maintain the treating agent in the liquid state at the operating temperature. Generally, the operating pressure will be in the range of about 1 to about 2000 psi.

The polishing surface and the diamond or diamond-like material to be processed are generally contacted together at suitable contacting velocities, and contacted together under suitable contacting pressure to provide the desired processed surface on the diamond or diamond-like material.

The contacting velocity between the polishing surface and the diamond or diamond-like material being processed, is generally suitable to provide the desired polishing in the desired timeframe. The contacting velocity is also limited by the frictional heat generated by the abrasive contacting of the polishing surface and the diamond or diamond-like material being polished, temperatures detrimental to the diamond or diamond-like material should be avoided. Of course, with a proper heat dissipation mechanism, higher contacting velocities may be utilized.

When a linear processing motion between the polishing surface and the material being processed is utilized, the lineal velocity will generally be less than about 10 m/s, of course depending upon the frictional heat generated and the heat dissipation as described above.

When a rotational processing motion between the polishing surface and the diamond or diamond-like material is utilized, the relative rotational velocity will generally be selected so that the maximum tip velocity along the contacting area does not exceed the above described relative linear velocity.

The contacting pressure is the amount of force used to contact the polishing surface with the diamond or diamond-like material per contact area between the polishing surface and the diamond or diamond-like material, as opposed to the operating pressure in which the process equipment resides. The contacting pressure is generally determined by the initial roughness of the diamond or diamond-like material to be processed, the thickness of the diamond or diamond-like material, the chemical nature of the material, and the warpage of the material. The applied weight for the contacting pressure will generally be less than about 100 kg per $cm^2$ of surface area being treated. Preferably, the applied weight for the contacting pressure will be less than about 70 kg per $cm^2$ of surface area being treated, and most preferably less than about 20 kg per $cm^2$ of surface area being treated.

The abrasive contacting is generally carried out for an amount of time suitable to achieve the desired finish on the material being processed. Generally, the abrasive contacting time is in the range of about 1 second to about 72 hours. Preferably, the abrasive contacting time is in the range of about 1 minute to about 24 hours, and most preferably in the range of about 30 minutes to about 12 hours.

The processed materials of the present invention will generally have a surface roughness of less than about 0.08 microns, and preferably less than about 0.05 microns. More preferably, the processed materials of the present invention will have a surface roughness of less than about 0.03 microns, and most preferably less than about 0.02 microns.

The processed materials of the present invention will generally have a thickness variation of less than about 8 percent, and preferably less than about 5 percent. More preferably, the processed materials of the present invention will have a thickness variation of less than about 2 percent, and most preferably less than about 1 percent.

The apparatus of the present invention will now be described by reference to FIGS. 1 and 2.

Referring now to FIG. 1 there is shown a schematic representation of polishing apparatus 10 of the present invention showing motor assembly 20, shaft assembly 30, polishing assembly 40, heating assembly 60, and jack assembly 70.

The apparatus 10 of the present invention generally includes a frame 12 to which is mounted motor assembly 20. Frame 12 can be made of any suitable materials, and is generally of proper design to support motor assembly 20 and other components as described below.

Motor assembly 20 includes motor mounting bracket 25 which secures motor 22 to frame 12. Although not shown, one or more bolts or retaining members secures motor 22 to mounting bracket 25, and secures motor mounting bracket 25 to frame 12. Motor 22 is generally of suitable horsepower to provide the desired rotational speed to motor shaft 27.

Shaft assembly 30 generally includes main shaft 34 which is coupled to motor shaft 27 by coupling 28. In the embodiment as shown, main shaft 34 passes through bushing 35 of main shaft stabilizing plate 31. Fasteners 33 serves to affix main shaft stabilizing plate 31 to frame 12.

Figure 2:
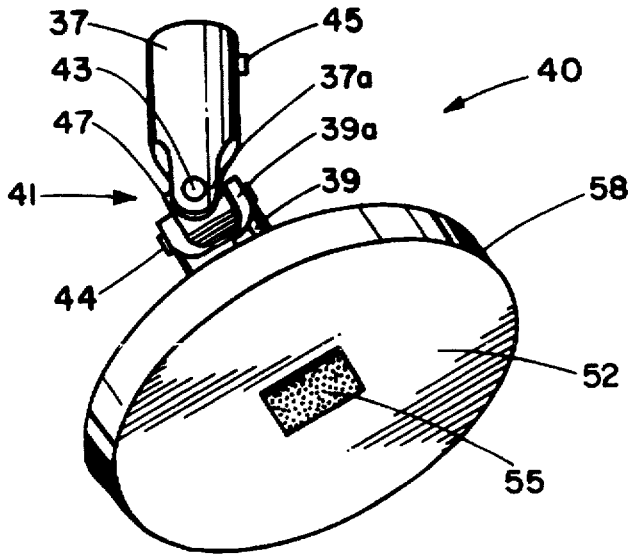
FIG. 2 is an enlarged view of polishing assembly 40 from FIG. 1.

Connected to the other end of main shaft 34 is polishing assembly 40 which includes a joint 41 and polishing support 58, which can be seen in more detail by referring additionally to FIG. 2. Joint 41 is generally suitable to provide the necessary motion to keep polishing support 58 in the desired alignment during the processing. In the embodiment shown, joint 41 is a standard universal joint having member 37 and member 39. Pin 45 affixes joint 41 to shaft 34. At end 37*a* of member 37, pivot pin 43 affixes member 37 to block 47. Member 39 is connected to block 47 by pivot pin 44. Member 39 is either an integral part of or affixed to polishing support 58. Polishing support further includes mounting surface 52 to which diamond or diamond-like material 55 to be processed is mounted. Diamond or diamond-like material 55 is generally affixed to mounting surface 52 with a glue, adhesive or other such material, which must be suitable to withstand the operating conditions, vibrational rigors of the process, and the chemical environment of the process.

Glues or adhesives suitable for use in the present invention are generally high temperature resistant glues from which the film can be easily extracted once the processing is complete. Non-limiting examples of suitable glues or adhesives include ceramic cements, particularly alumina cements, for example those available under the tradename Ceramabond 569 available from AREMCO Products, Inc. of New York. Such alumina cements are preferred, as the film may be unglued from the mounting surface by contacting with water or other suitable solvent.

The apparatus of the present invention further includes heating assembly 60 which includes heater 66 and polishing surface 64. Polishing support 58 and polishing surface 64 are brought together in a suitable fashion so that diamond or diamond-like material 55 will abrasively contact polishing surface 64. While in the embodiment shown, polishing support 58 is rotated and polishing surface 64 is rotated, it is to be understood that either or both can be rotated. Additionally, the polishing motion of the present invention is not to be limited to rotational motion as any suitable polishing motion may be utilized.

Residing between polishing support 58 and polishing surface 64 is processing medium 65 which may comprise a treating agent and/or polishing agent. Depending upon the orientation of the polishing support 58 and polishing surface 64, processing medium 65 may by supported by either one or both. In the embodiment shown, processing medium 65 will be supported by polishing surface 64. As diamond or diamond-like material 55 will be between polishing support 58 and polishing surface 64, preventing support 58 and surface 64 from completely contacting and thus squeezing out all liquids, there is a suitable amount of space between them for processing medium 65 to reside. However, processing medium 65 can be enhanced, by providing grooves, drill holes or other suitable orifices in the surface of polishing support 58 and/or polishing surface 64 to help retain liquid between them. When grooves are utilized, they may be in the form of a grid, concentric circles or any other suitable pattern.

While in the embodiment shown, polishing surface 64 is shown separately from heater 66, it is understood that polishing surface 64 could also be an integral part of heater 66. As shown, heater 66 is a hot plate type of heater. However, as the purpose of heater 66 is to heat the treating agent and the polishing agent to a liquid state, any suitable type of heater may be utilized. For example, heater 66 could circulate a heating fluid through polishing surface 64, or heater 66 could heat polishing surface through resistance heating. It is also to be understood that while polishing surface 64 is shown as being heated, in the practice of the present invention, polishing surface 64 and/or mounting surface 52 may be heated. Polishing surface 64 is secured to heater 66 by the means of straps 61 which are affixed at one end to heater 66 and at the other end to polishing surface 64. The temperature of heater 66 may be set utilizing temperature control 67 shown on the front of heater body 68.

Jack assembly 70 supports heater 66 and includes jack stand 77, frame 76 and height adjustment control 74.

In the operation of apparatus 10 of the present invention, diamond or diamond-like material 55 is mounted on mounting surface 52 using an alumina based cement adhesive. The treating agent and polishing agent are placed on polishing surface 64, in grooves if they exist, with the treating agent and polishing agent brought to the proper temperature using temperature control 67. With motor 22 providing the proper rotational speed to polishing support 58, height adjustment control 74 is used to bring the polishing surface 64 and material 55 together with suitable force to achieve desired polishing. Of course, during the course of processing, it may be necessary further to adjust control 74.

It is also envisioned that the height adjustment, temperature control and rotational speed of the present invention may be automated and controlled through the use of a computer controller. It is further envisioned that the application of a suitable electric field to bias the polishing agent and/or treating agent will improve the polishing performance. While not wishing to be limited by theory, the inventors believe that such an electric field will assist in the generation of chemical radicals to aid in the polishing.

Figure 3:
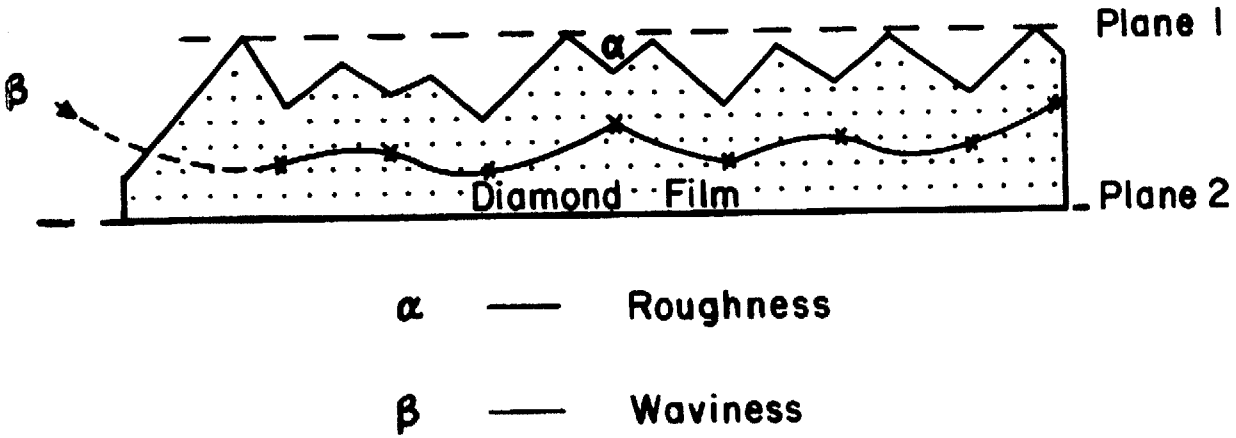
FIG. 3 is an illustration of the concepts of waviness and roughness.

The method of the present invention both polishes, i.e., reduces the average surface roughness, and planarizes, i.e., reduces the waviness. FIG. 3 is an illustration of the concepts of waviness and surface roughness. Surface roughness is the depth of the cracks and crevices measured from a certain plane 1 above. Waviness is the line through the mid-points between plane 2 and the lower peaks in the surface.

The method and apparatus of the present invention both find utility in treating surfaces comprising diamond, ceramic metal oxides such as $Al_2O_3$, nitrides such as such as cubic BN, SiN, AlN, TiN, NbN, ZrN and HfN, carbides such as SiC, TiC, NbC, ZrC and HfC, WC, any other diamond-like coatings and combinations thereof.

The processed materials of the present invention, especially highly polished diamond films, will find utility in thermal management, electrical, optical and tribological applications.

EXAMPLE

A diamond film substrate, produced by a conventional chemical vapor deposition process, having a cross-sectional area of 1 $cm^2$, an average thickness of about 700 microns, a typical surface roughness of about 2.7 microns, and having about 8% variation in the thickness.

The substrate was first cleaned in "aqua regia" a mixture of nitrohydrochloric acid, chloronitrous acid and chlorazotic acid, then rinsed in deionized water, followed by ultrasonic cleaning in methanol, after which it was dried utilizing dry nitrogen.

The apparatus used in this example is illustrated in FIGS. 1 and 2 discussed above. The diamond film substrate is then mounted on the mounting surface using an alumina based cement as the mounting adhesive.

Figure 4:
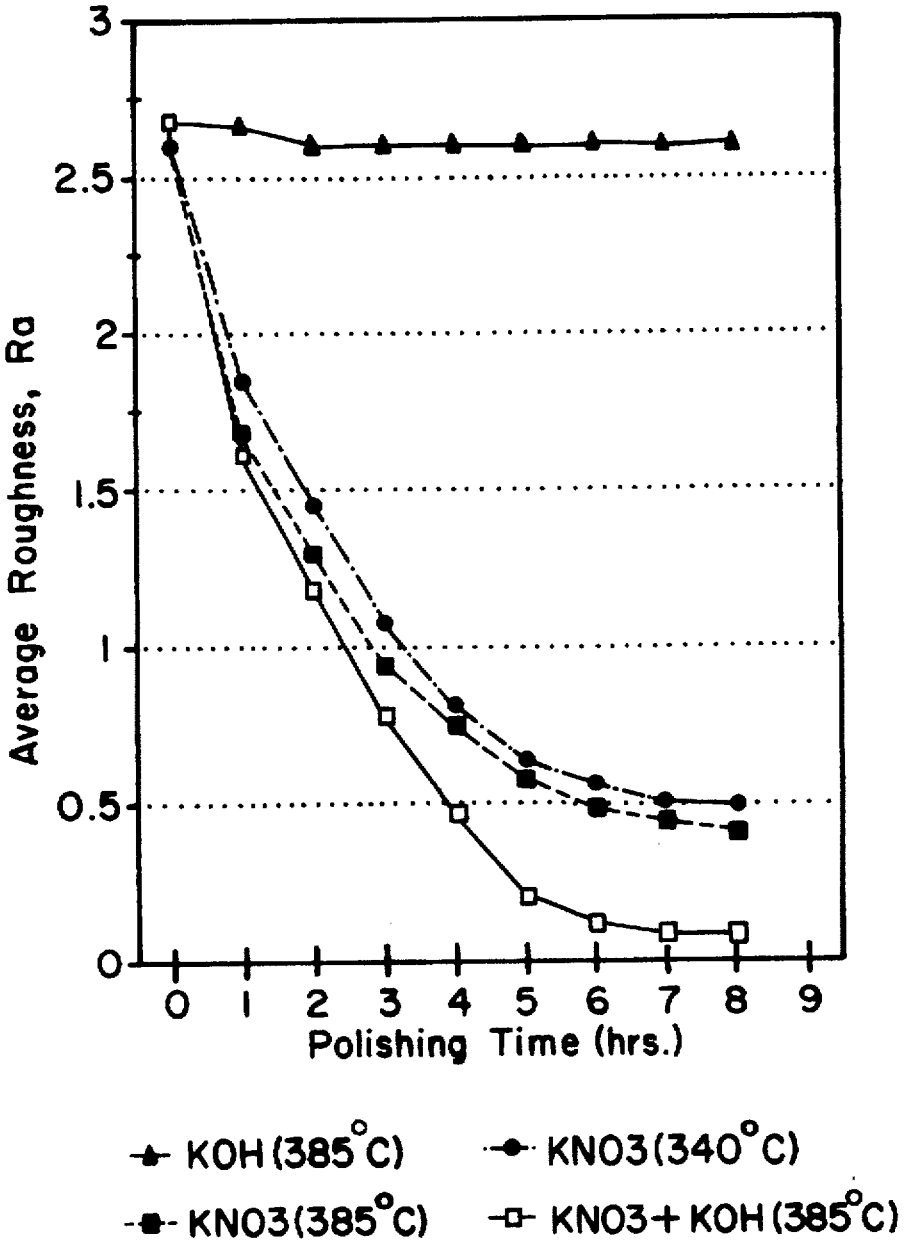
FIG. 4 is a graph of average surface roughness versus polishing time for diamond films that have been polished utilizing potassium nitrate, potassium hydroxide, and a combination of potassium nitrate and potassium hydroxide.

For various substrates, the following chemicals were utilized either (1) potassium hydroxide; (2) potassium nitrate, and (3) a 95:5 by weight mixture of potassium nitrate and potassium hydroxide, at a processing temperature of 385° C. A substrate was also processed with potassium nitrate at 340° C. Average roughness was determined after each hour of polishing, with typical results presented in FIG. 4 which is a graph of average surface roughness versus polishing time for diamond films that have been polished utilizing potassium nitrate, potassium hydroxide, and a combination of potassium nitrate and potassium hydroxide. As clearly shown in FIG. 4, the combination of potassium nitrate and potassium hydroxide acts in a synergistic fashion to provide for faster polishing rates and greater polishing (lower average roughness).

Figure 5:
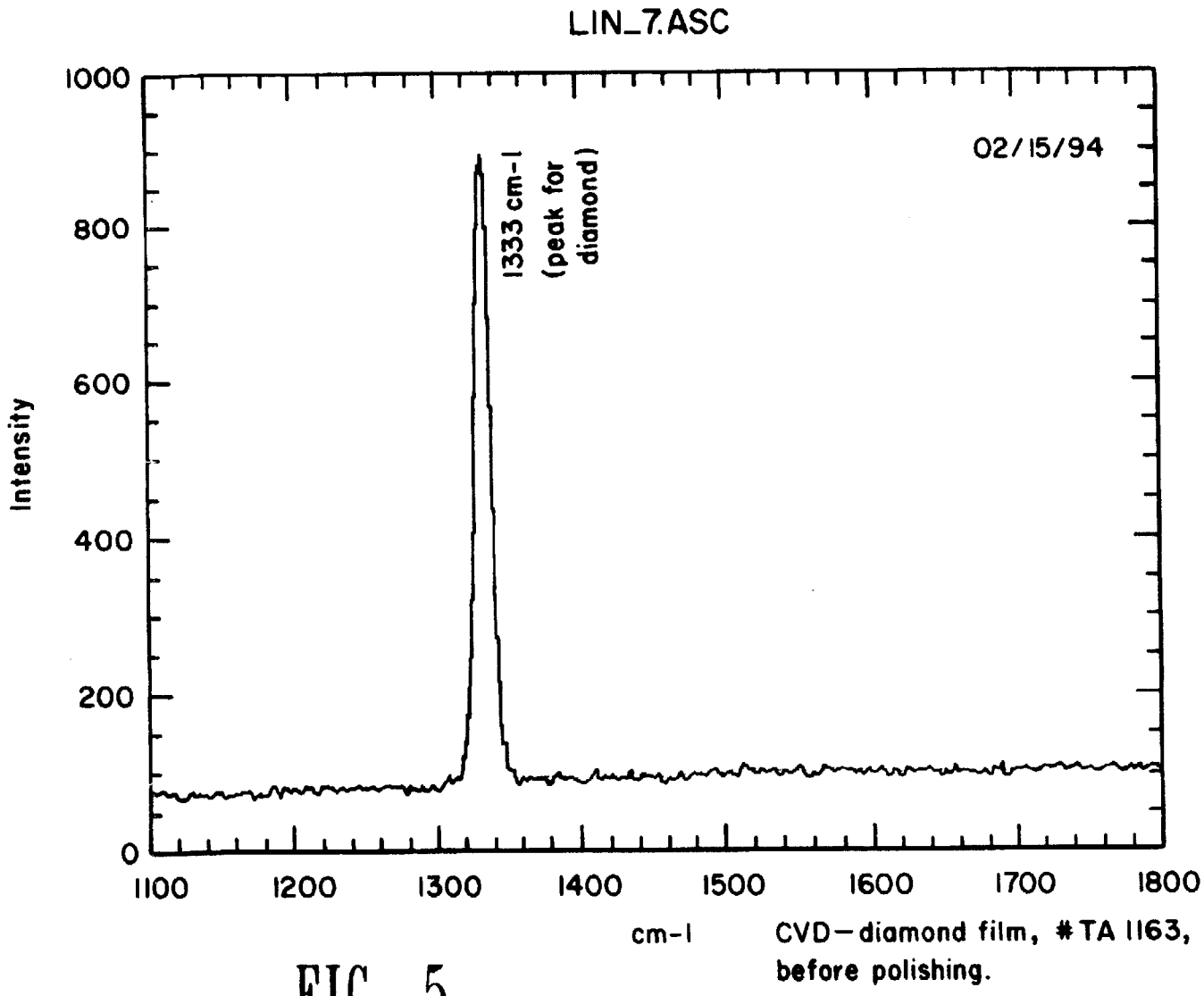
FIG. 5 is a RAMAN spectroscopy graph showing the purity of a diamond film before processing by the method of the present invention.

FIG. 5 is a RAMAN spectroscopy graph showing the purity of a diamond film before processing with the mixture of potassium nitrate and potassium hydroxide at 385° C. by the method of the present invention.

Figure 6:
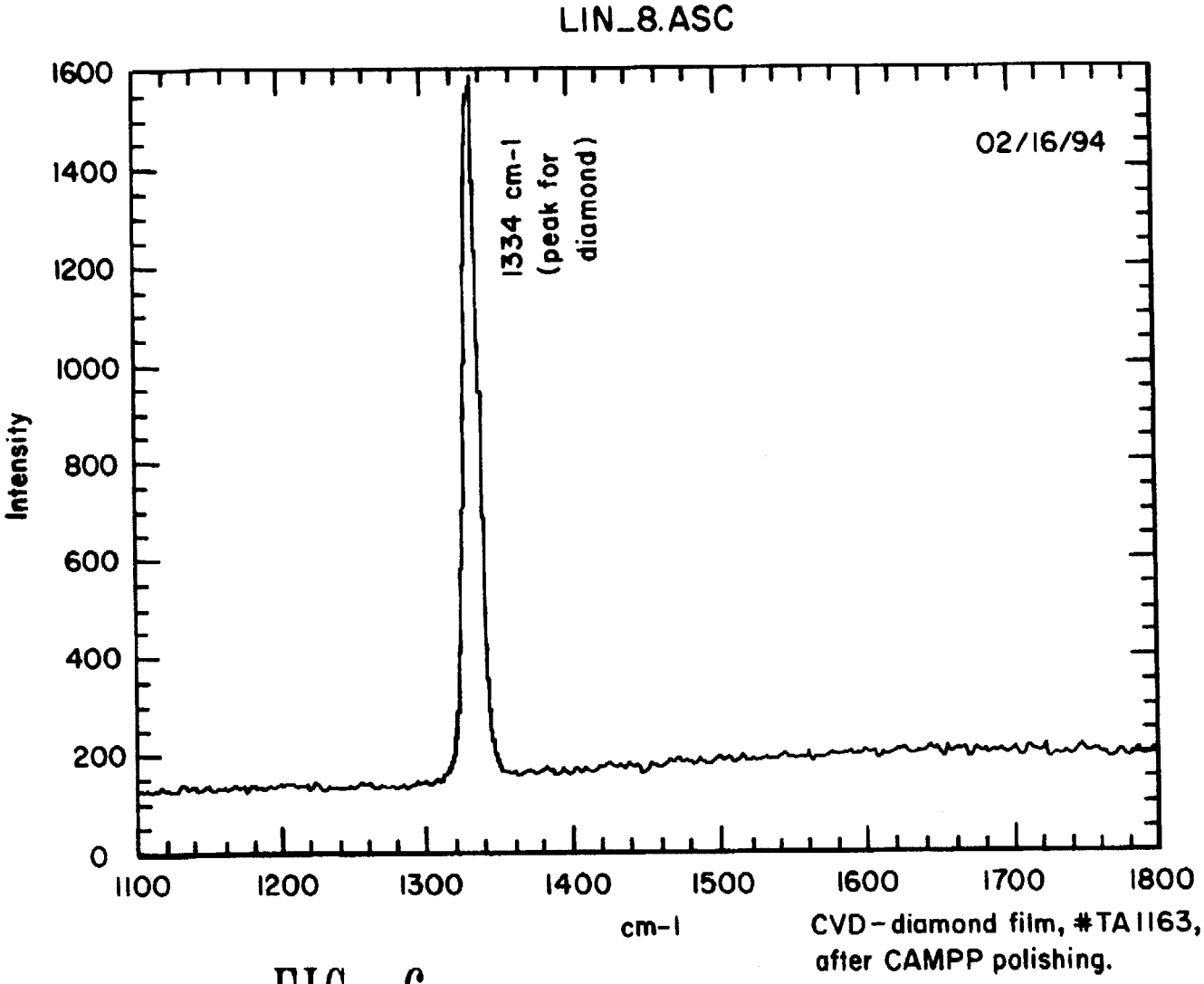
FIG. 6 is a RAMAN spectroscopy graph showing the purity of a diamond film after processing by the method of the present invention.

FIG. 6 is a RAMAN spectroscopy graph showing the purity of a diamond film after processing with the mixture of potassium nitrate and potassium hydroxide at 385° C. by the method of the present invention.

Comparing FIGS. 5 and 6, it is clear that the process of the present invention does not impart any substantial amount of contamination to the processed substrate. The final processed substrate is essentially free of process-induced contaminants and consists essentially of the substrate material, in this instance, the final processed substrate consists essentially of diamond.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A process for treating a first superhard surface comprising abrasively contacting the superhard surface with a second superhard surface at sufficient pressure and velocity to polish the first superhard surface, wherein the abrasive contacting occurs in the presence of a liquid treating agent and a polishing agent.

2. The process of claim 1 wherein the first superhard surface comprises diamond and the second superhard surface comprises at least one material selected from the group of materials consisting of metal carbides, metal oxides, metal nitrides, and ceramics.

3. The process of claim 2 wherein the polishing agent and the treating agent are independently selected from the group of agents consisting of chlorides, nitrates, hydroxides, nitrites, fluorides and sulfides.

4. The process of claim 2 wherein the abrasive contacting occurs at a temperature less than about 900K. and an operating pressure in the range of about 1 to about 2000 psi.

5. The process of claim 2 wherein the treating agent and the polishing agent are independently selected from the group of agents consisting of potassium chloride, potassium nitrite, potassium hydroxide, sodium hydroxide, sodium nitrate, sodium nitrite, chromium trioxide, potassium-dichromate, manganese oxide, potassium chromate and mixtures thereof.

6. The process of claim 5 wherein the polishing agent comprises potassium hydroxide.

7. The process of claim 6 wherein the treating agent comprises potassium nitrate.

8. A process for treating a diamond surface comprising abrasively contacting the diamond surface with a superhard surface at sufficient pressure and velocity to polish the diamond surface, wherein the superhard surface has a Mohs hardness of at least 5, and wherein the abrasive contacting occurs in the presence of a liquid treating agent and a polishing agent.

9. The process of claim 8 wherein the polishing agent and the treating agent are each independently selected from the group of agents consisting of chlorides, nitrates, hydroxides, nitrites, fluorides and sulfides.

10. The process of claim 8 wherein the treating agent and the polishing agent are each independently selected from the group of agents consisting of potassium chloride, potassium nitrite, potassium hydroxide, sodium hydroxide, sodium nitrate, sodium nitrite, chromium trioxide, potassium-dichromate, manganese oxide, potassium chromate and mixtures thereof.

11. The process of claim 10 wherein the polishing agent comprises in the range of about 1 to about 10 weight percent and the treating agent comprises in the range of about 90 to about 99 weight percent, based on the total weight of the treating agent and the polishing agent.

12. The process of claim 11 wherein the polishing agent comprises potassium hydroxide.

13. The process of claim 12 wherein the treating agent comprises potassium nitrate.

14. A process for treating a diamond film comprising (a) securing the diamond film to a substrate with a ceramic cement adhesive; and (b) abrasively contacting the film with a superhard surface at sufficient pressure and velocity to polish the film, wherein the superhard surface has a Mohs hardness of at least 5, and wherein the abrasive contacting occurs in the presence of a polishing medium.

15. The process of claim 14 wherein the polishing medium comprises at least one agent selected from the group of agents consisting of chlorides, nitrates, hydroxides, nitrites, fluorides and sulfides.

16. The process of claim 14 wherein the polishing medium comprises at least one agent selected from the group of agents consisting of potassium chloride, potassium nitrite, potassium hydroxide, sodium hydroxide, sodium nitrate, sodium nitrite, chromium trioxide, potassium-dichromate, manganese oxide, potassium chromate and mixtures thereof.

17. The process of claim 14 wherein the polishing medium comprises potassium nitrate and potassium hydroxide.

18. The process of claim 14 wherein the ceramic cement adhesive comprises alumina cement adhesive.

19. The process of claim 18 further comprising:

(c) contacting the adhesive with a solvent suitable to release the film from the substrate.

20. The process of claim 19 wherein the solvent is water.

21. The process of claim 19 wherein the polishing medium comprises potassium nitrate and potassium hydroxide.

22. A planarized polished diamond film comprising a polished surface having an average surface roughness of less than about 0.05 microns, and having a percent variation in the thickness of the film of less than 8 percent, and consisting essentially of diamond.

23. The film of claim 22 wherein the roughness is less than about 0.03 microns and wherein the percent variation is less than about 5 percent.

24. The film of claim 22 wherein the roughness is less than about 0.02 microns and wherein the percent variation is less than about 2 percent.

25. An apparatus for abrasively processing a diamond or diamond-like material comprising (a) a frame;

(b) a motor supported by the frame;

(c) a mounting plate connected to and rotationally powered by the motor and adapted to support the diamond or diamond-like material;

(d) a polishing plate adapted to abut against the diamond or diamond-like material supported by the mounting plate;

(e) a processing medium between the mounting plate and the polishing plate;

(f) a heater for keeping the processing medium in the liquid state.

26. The apparatus of claim 25 wherein the processing medium comprises a polishing agent and a treating agent wherein the treating agent and the polishing agent are independently selected from the group of agents consisting of chlorides, nitrates, hydroxides, nitrites, fluorides and sulfides.

27. The apparatus of claim 25 wherein the polishing agent and the treating agent are independently selected from the group of agents consisting of potassium chloride, potassium nitrite, potassium hydroxide, sodium hydroxide, sodium nitrate, sodium nitrite, chromium trioxide, potassium-dichromate, manganese oxide, potassium chromate and mixtures thereof.

28. The apparatus of claim 25 wherein the medium comprises potassium nitrate and potassium hydroxide.

29. The apparatus of claim 25 wherein the mounting plate is connected to the motor by a drive shaft having a joint which keeps the mounting plate abutted with the polishing plate during the abrasive polishing.

* * * * *